US011927351B2

(12) United States Patent
Singh et al.

(10) Patent No.: US 11,927,351 B2
(45) Date of Patent: Mar. 12, 2024

(54) OUTDOOR AIR HOOD ASSEMBLY WITH AN INLET HOOD

(71) Applicant: Johnson Controls Technology Company, Auburn Hills, MI (US)

(72) Inventors: Gurpreet Singh, Pune (IN); Prashanti S. Dhawan, Pune (IN); Nitin A. Kurane, Pune (IN); Anand Talikot, Belgaum (IN)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 401 days.

(21) Appl. No.: 17/235,726

(22) Filed: Apr. 20, 2021

(65) Prior Publication Data

US 2021/0332991 A1 Oct. 28, 2021

(30) Foreign Application Priority Data

Apr. 20, 2020 (IN) ..... 202011016873

(51) Int. Cl.
*F24F 1/58* (2011.01)
*F24F 1/48* (2011.01)

(52) U.S. Cl.
CPC . *F24F 1/58* (2013.01); *F24F 1/48* (2013.01)

(58) Field of Classification Search
CPC ..... F24F 1/48; F24F 1/58; F24F 13/28
USPC ..... 454/275
See application file for complete search history.

(56) References Cited

U.S. PATENT DOCUMENTS

| | | | | |
|---|---|---|---|---|
| 2,538,286 | A * | 1/1951 | Todd | E04F 10/10 160/132 |
| 4,843,839 | A * | 7/1989 | Davis | F24F 1/0038 454/236 |
| 5,050,488 | A * | 9/1991 | Beasley | F24F 1/0047 454/321 |
| 7,410,520 | B2 * | 8/2008 | Nowak | B01D 46/0016 55/497 |
| 10,245,542 | B2 | 4/2019 | Knuckles | |
| 10,427,079 | B2 | 10/2019 | Barry et al. | |

* cited by examiner

*Primary Examiner* — Allen R. B. Schult
(74) *Attorney, Agent, or Firm* — Fletcher Yoder, PC

(57) ABSTRACT

A hood assembly for a heating, ventilation, and air conditioning (HVAC) unit includes a top panel comprising a first panel portion and a second panel portion adjustably coupled to one another, wherein the top panel is configured to rotatably couple to a housing of the HVAC unit. The hood assembly further includes a filter frame rotatably coupled to the top panel, wherein the filter frame is configured to support at least one filter. The hood assembly is adjustable between a collapsed configuration and a deployed configuration, the first panel portion and the second panel portion are configured to translate relative to one another during transition of the hood assembly between the collapsed configuration and the deployed configuration, and the top panel is configured to contain the filter frame within the housing in the collapsed configuration.

20 Claims, 12 Drawing Sheets

OUTDOOR AIR HOOD ASSEMBLY WITH AN INLET HOOD

CROSS REFERENCE TO RELATED APPLICATION

This application claims priority from and the benefit of India Provisional Application Serial No. 202011016873, entitled "AN OUTDOOR AIR HOOD ASSEMBLY WITH AN INLET HOOD," filed Apr. 20, 2020, which is hereby incorporated by reference in its entirety for all purposes.

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and air conditioning (HVAC) systems are utilized to control environmental properties, such as temperature and humidity, for occupants of residential, commercial, and industrial environments. The HVAC systems may control the environmental properties through control of an air flow delivered to the environment. In some cases, the HVAC systems include an intake hood that is configured to block water, dust, debris, and other contaminants from entering the HVAC system. For instance, an outdoor HVAC unit may draw air into the unit from the intake hood, and the air may ultimately flow across a heat exchanger to exchange thermal energy with a working fluid (e.g., refrigerant) flowing through the heat exchanger. Existing intake hoods are generally shipped separately from a housing of the HVAC unit and are therefore assembled upon delivery, which increases transportation, delivery, and installation costs and may be time-consuming. Accordingly, it is now recognized that improved assembly and transportation management for HVAC units having intake hoods is desired.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, a hood assembly for a heating, ventilation, and air conditioning (HVAC) unit comprises a top panel comprising a first panel portion and a second panel portion adjustably coupled to one another, wherein the top panel is configured to rotatably couple to a housing of the HVAC unit. The HVAC unit further comprises a filter frame rotatably coupled to the top panel, wherein the filter frame is configured to support at least one filter. The hood assembly is adjustable between a collapsed configuration and a deployed configuration, the first panel portion and the second panel portion are configured to translate relative to one another during transition of the hood assembly between the collapsed configuration and the deployed configuration, and the top panel is configured to contain the filter frame within the housing in the collapsed configuration.

In another embodiment, a heating, ventilation, and air conditioning (HVAC) unit comprises a housing and an intake hood assembly coupled to the housing and configured to transition between a collapsed configuration and a deployed configuration. The HVAC unit further comprises a top cover of the intake hood rotatably coupled to the housing and comprising a first panel and a second panel, wherein the second panel is configured to translate relative to the first panel during transition of the intake hood assembly between the collapsed configuration and the deployed configuration. The HVAC unit further comprises a filter frame rotatably coupled to the top cover and configured to support at least one filter, wherein the top cover and the filter frame are configured to rotate relative to one another and relative to the housing during transition of the intake hood assembly between the collapsed configuration and the deployed configuration.

In another embodiment, an intake hood assembly for a heating, ventilation, and air conditioning (HVAC) unit includes a top panel comprising a first panel portion and a second panel portion adjustably coupled to one another, wherein the top panel is configured to couple to a housing of the HVAC unit. The intake hood assembly further includes a filter frame coupled to the top panel, wherein the filter frame comprises a first sub-frame configured to support a first filter and a second sub-frame configured to support a second filter. The intake hood assembly is adjustable between a collapsed configuration and a deployed configuration, the first panel portion and the second panel portion are configured to translate relative to one another during transition of the intake hood assembly between the collapsed configuration and the deployed configuration, and the first sub-frame and the second sub-frame are configured to rotate relative to one another during transition of the intake hood assembly between the collapsed configuration and the deployed configuration.

DRAWINGS

Various aspects of this disclosure may be better understood upon reading the following detailed description and upon reference to the drawings in which.

Figure 8A:
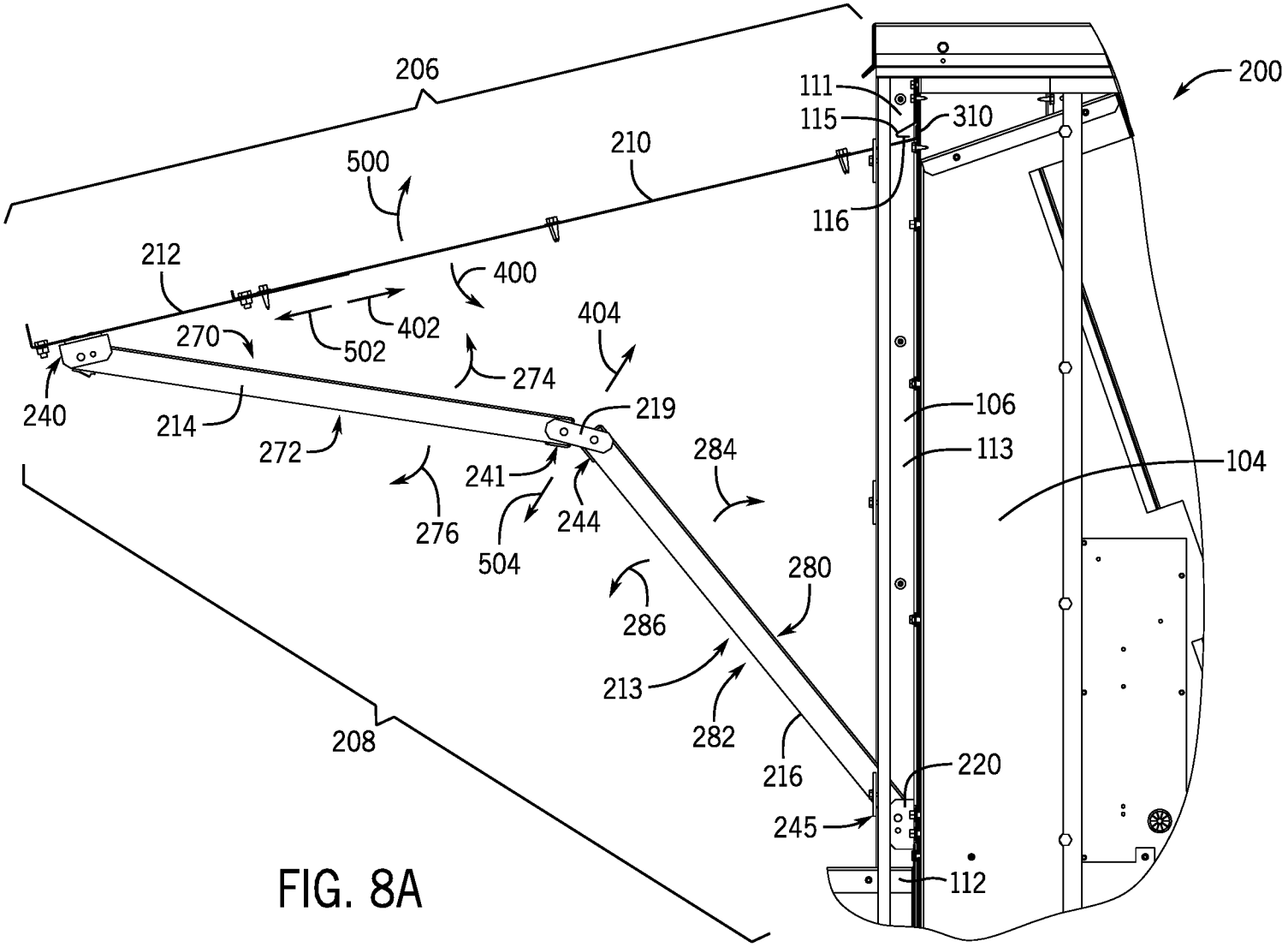
FIG. 8A is a schematic side view illustrating transition of an embodiment of an air hood assembly between a deployed configuration and a collapsed configuration, in accordance with an aspect of the present disclosure.
Figure 8B:
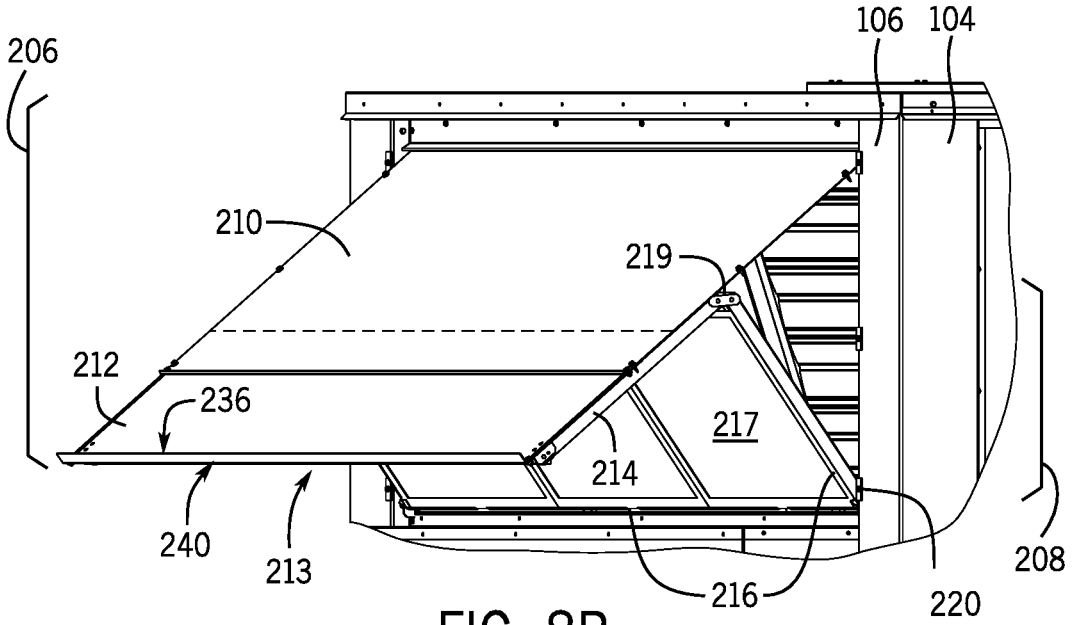
Figure 9:
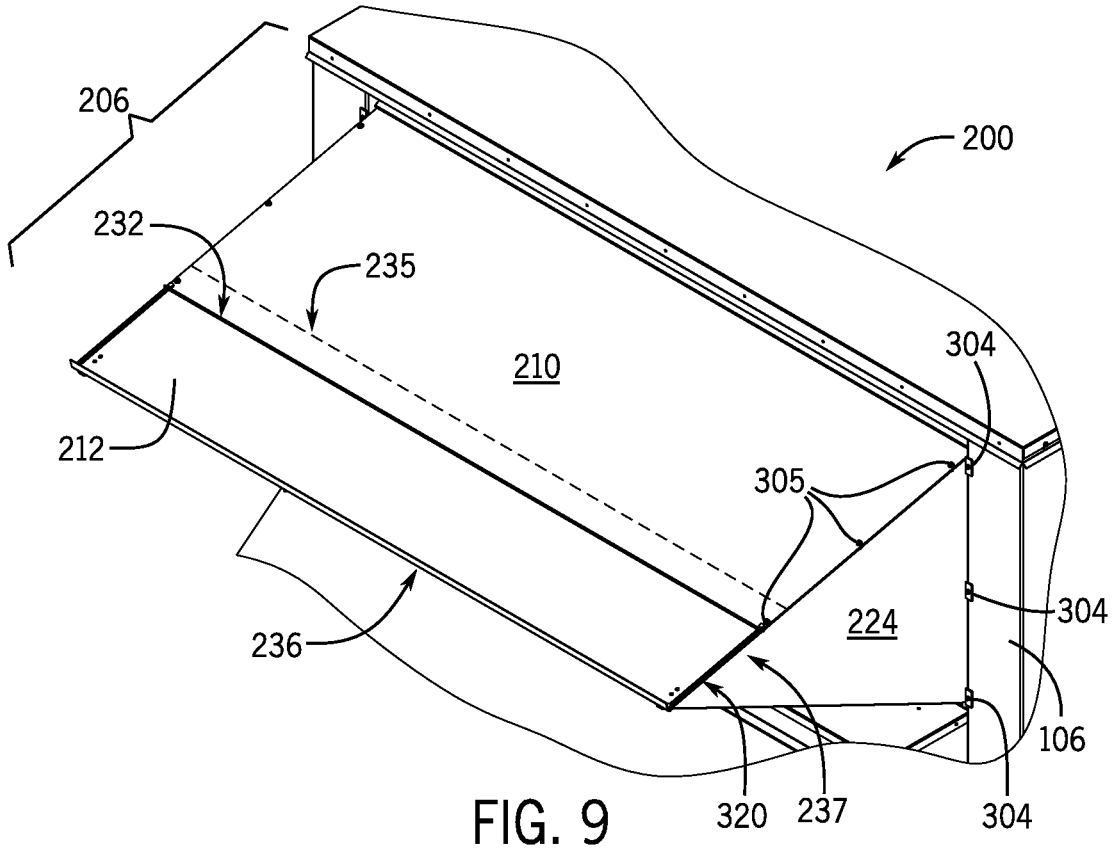
Figure 10A:
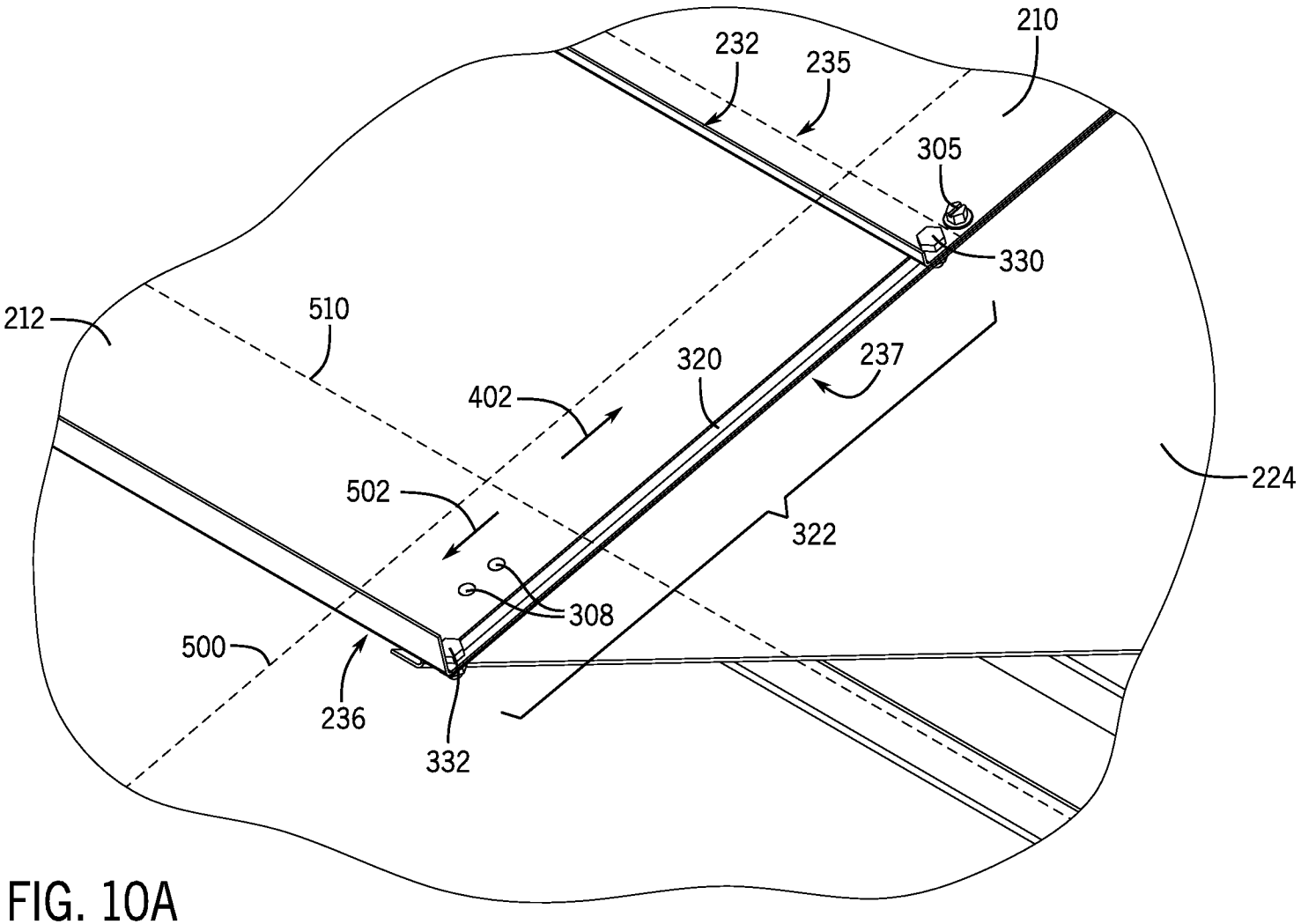
Figure 10B:
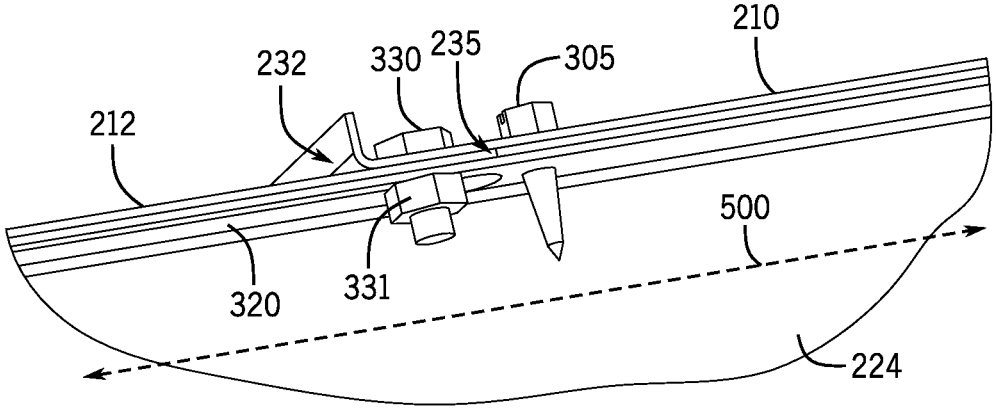
Figure 11A:
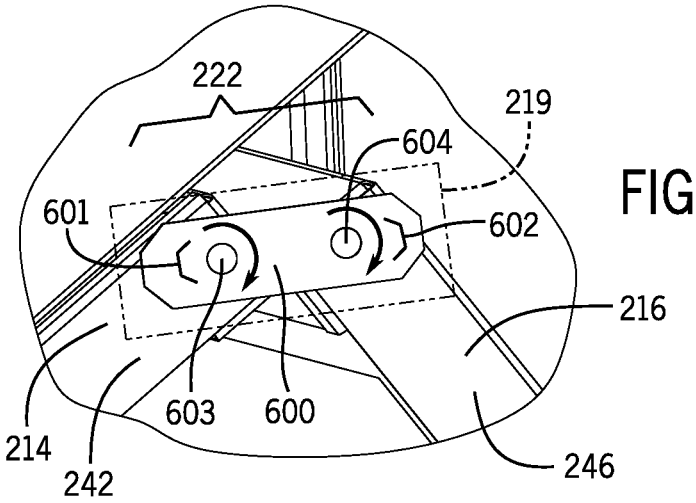
Figure 11B:
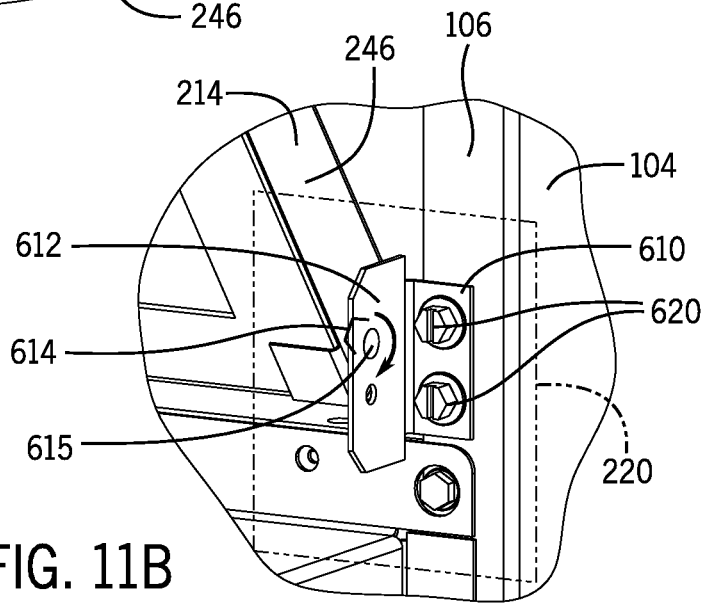
Figure 12:
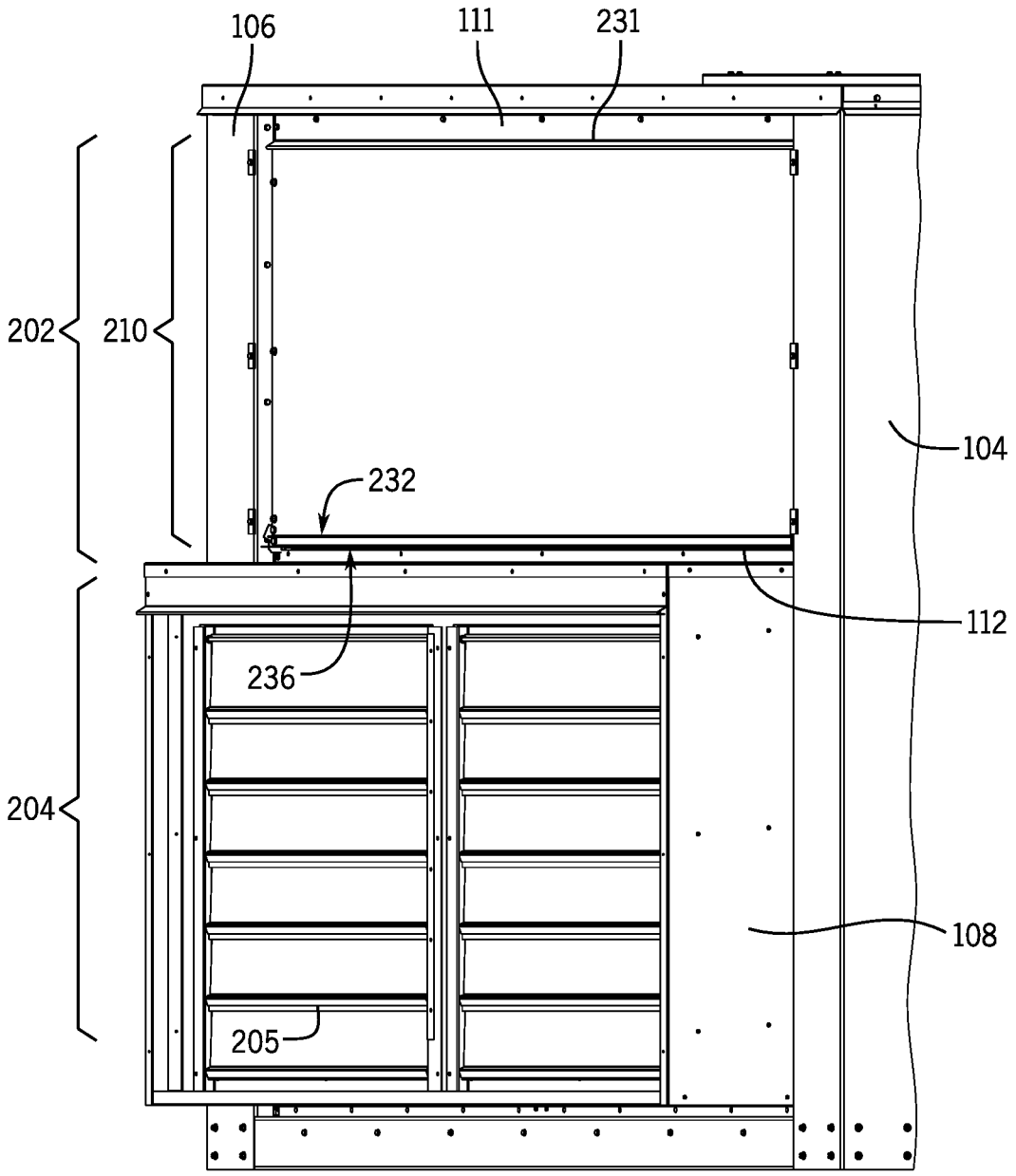
Figure 13:
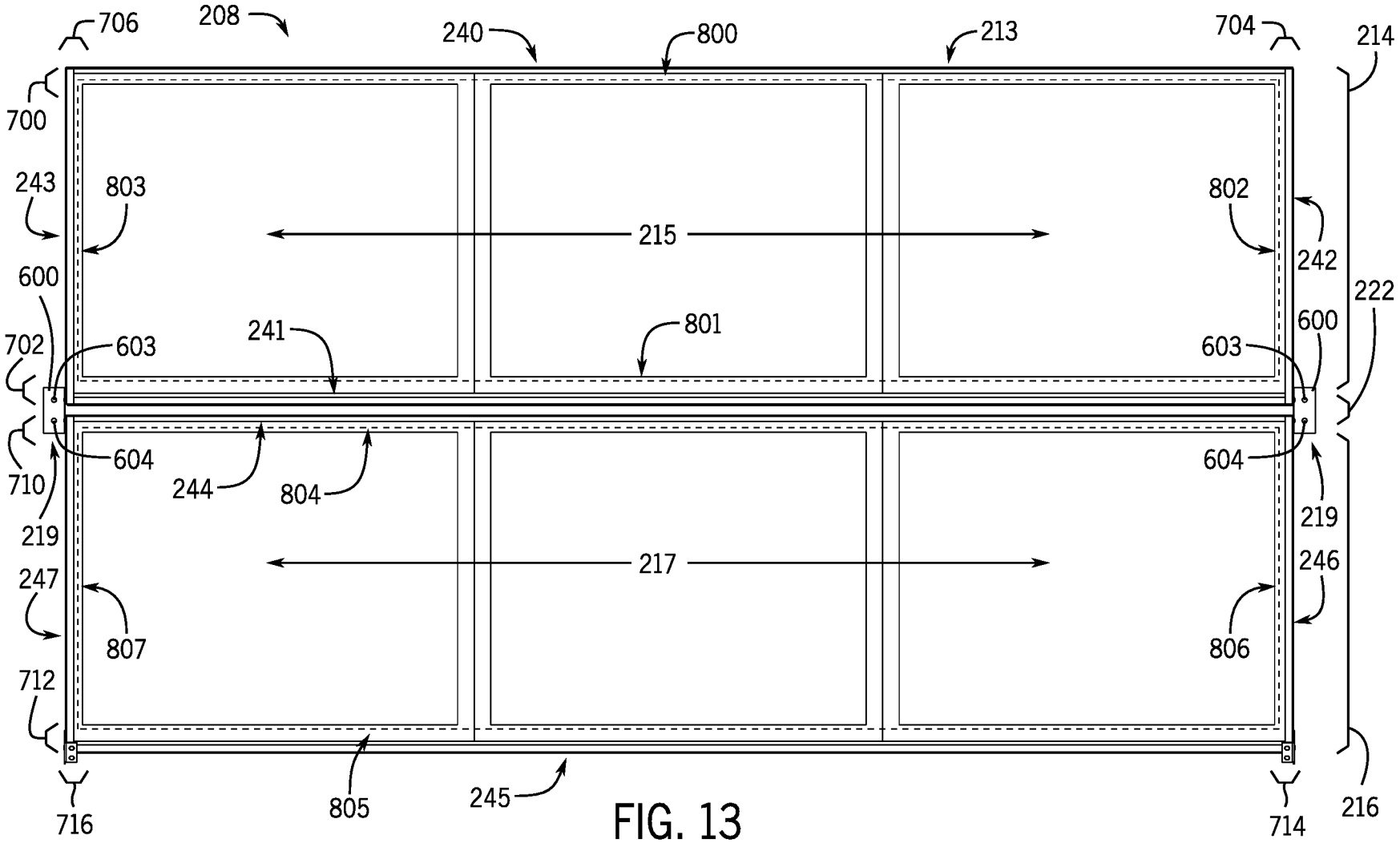

FIG. 8B a perspective view of an embodiment of an air hood assembly, illustrating transition between a deployed configuration and a collapsed configuration, in accordance with an aspect of the present disclosure;

FIG. 9 is a perspective view of an embodiment of an air hood assembly, in accordance with an aspect of the present disclosure;

FIG. 10A is an expanded perspective view of an embodiment of an air hood assembly, illustrating panel portions of the air hood assembly, in accordance with an aspect of the present disclosure;

FIG. 10B is an expanded perspective view of an embodiment of an air hood assembly, illustrating coupled panel portions of the air hood assembly, in accordance with an aspect of the present disclosure;

FIG. 11A is a perspective view of an embodiment of a connection between filter frames of an air hood assembly, in accordance with an aspect of the present disclosure;

FIG. 11B is a perspective view of an embodiment of a connection between a filter frame of an air hood assembly and a housing frame, in accordance with an aspect of the present disclosure;

FIG. 12 is a perspective view of an embodiment of an air hood assembly in a collapsed configuration, in accordance with an aspect of the present disclosure; and FIG. 13 is a schematic of an embodiment of a filter assembly of an air hood assembly, in accordance with an aspect of the present disclosure.

DETAILED DESCRIPTION

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to an improved hood assembly (e.g., air hood assembly, air intake hood assembly) configured to be disposed over an air intake (e.g., air inlet) of a heating, ventilation, and air conditioning (HVAC) unit. As discussed above, existing air hoods may be removed and/or otherwise disassembled to an HVAC unit when the HVAC unit is to be transported from one location to another. As such, the HVAC unit and the air hood are shipped to a new location separately from one another, which may increase transportation costs. The air hood must also be assembled, or otherwise attached, to the HVAC unit when the separate components reach the final destination, which may be time-consuming and costly.

Accordingly, embodiments of the present disclosure are directed to a collapsible air hood assembly that is configured to transition between a collapsed configuration and a deployed configuration. In some embodiments, the air hood assembly may include a top panel having a first panel and a second panel and having a pair of side panels removably coupled to the top panel. When the air hood assembly is in the deployed configuration, the air hood assembly is configured to block water and other elements, such as dust, debris, and/or dirt particles present in an environment surrounding the HVAC unit, from entering the HVAC unit via an air intake, while also enabling air to flow from the environment surrounding the HVAC unit into the HVAC unit via the air intake. When the air hood assembly is in the collapsed configuration, the pair of side panels may be removed such that the top panel of the air hood assembly may transition and rest generally flush with a side of the HVAC unit. As such, the air hood assembly may be transported with the HVAC unit in an assembled or installed configuration without substantially increasing the size (e.g., footprint) of the HVAC unit, thereby reducing the time and costs associated with transportation, delivery, and assembly of the HVAC unit.

Figure 1:
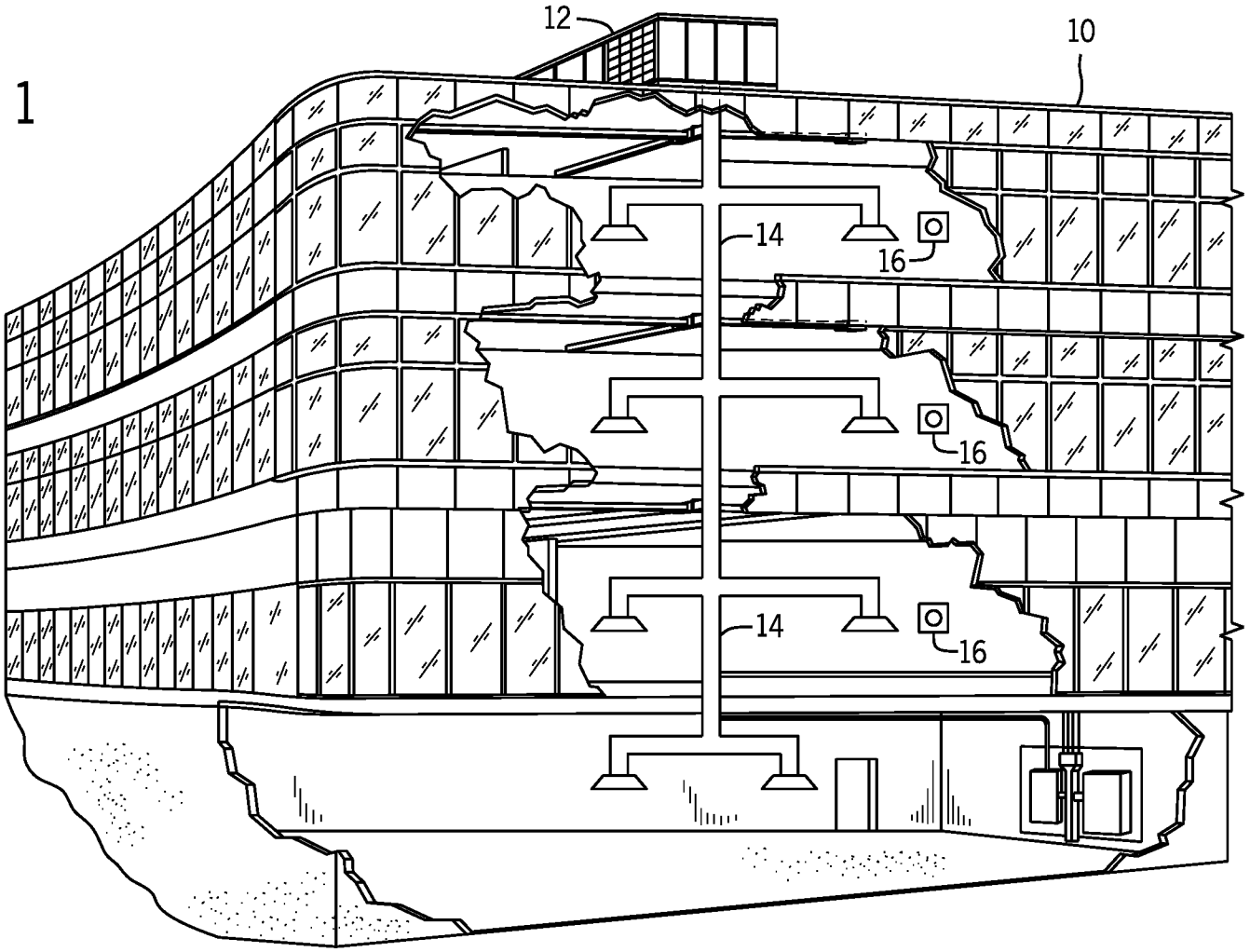
FIG. 1 is a perspective view of a building having an embodiment of a heating, ventilation, and air conditioning (HVAC) system for environmental management that may employ one or more HVAC units, in accordance with an aspect of the present disclosure.

Turning now to the drawings, FIG. 1 illustrates a heating, ventilation, and air conditioning (HVAC) system for building environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or one or more zones (101, 102, 103) of the building 10 and each zone may further comprise one or more outdoor air hoods equipped with filters. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
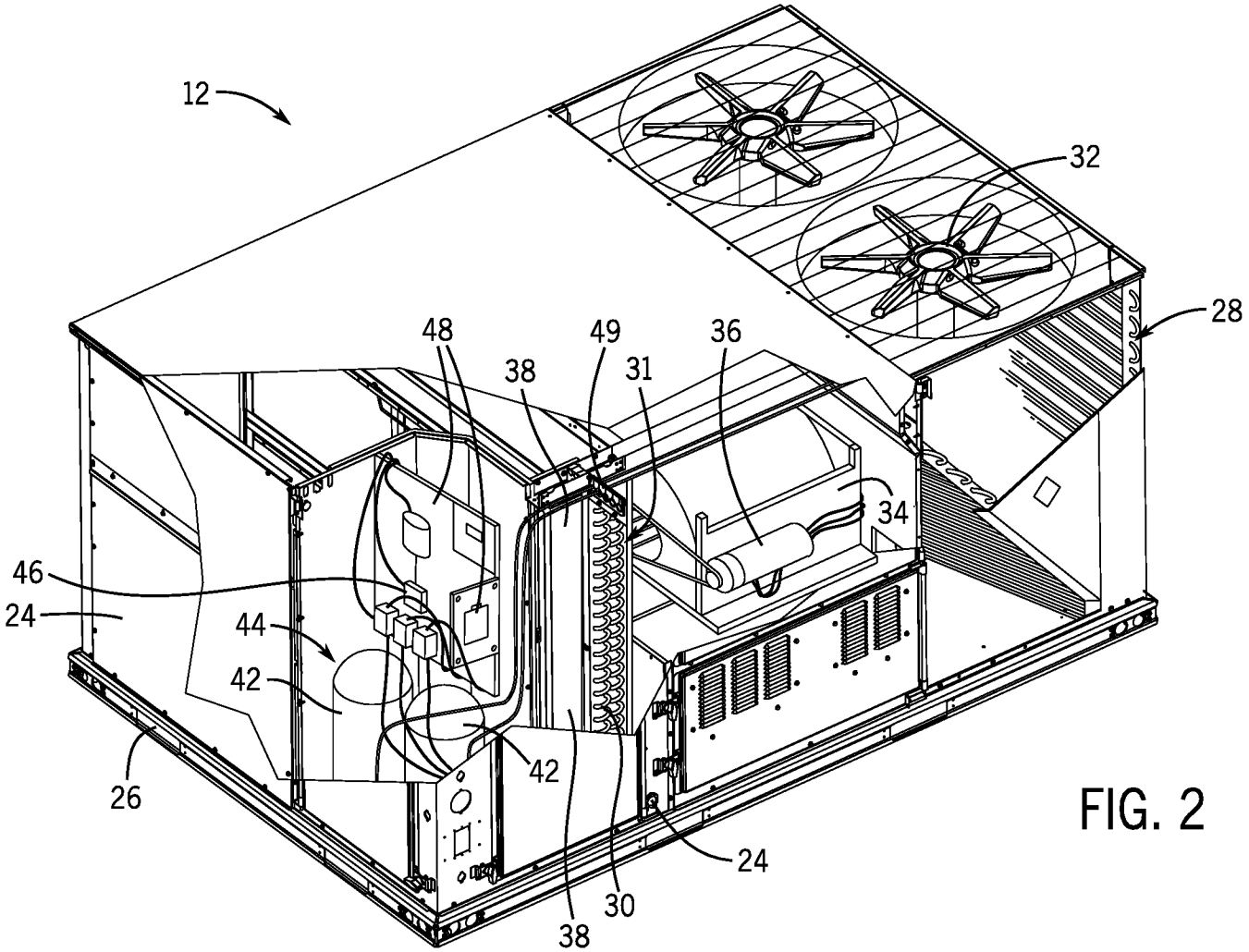
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit onto "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. Additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
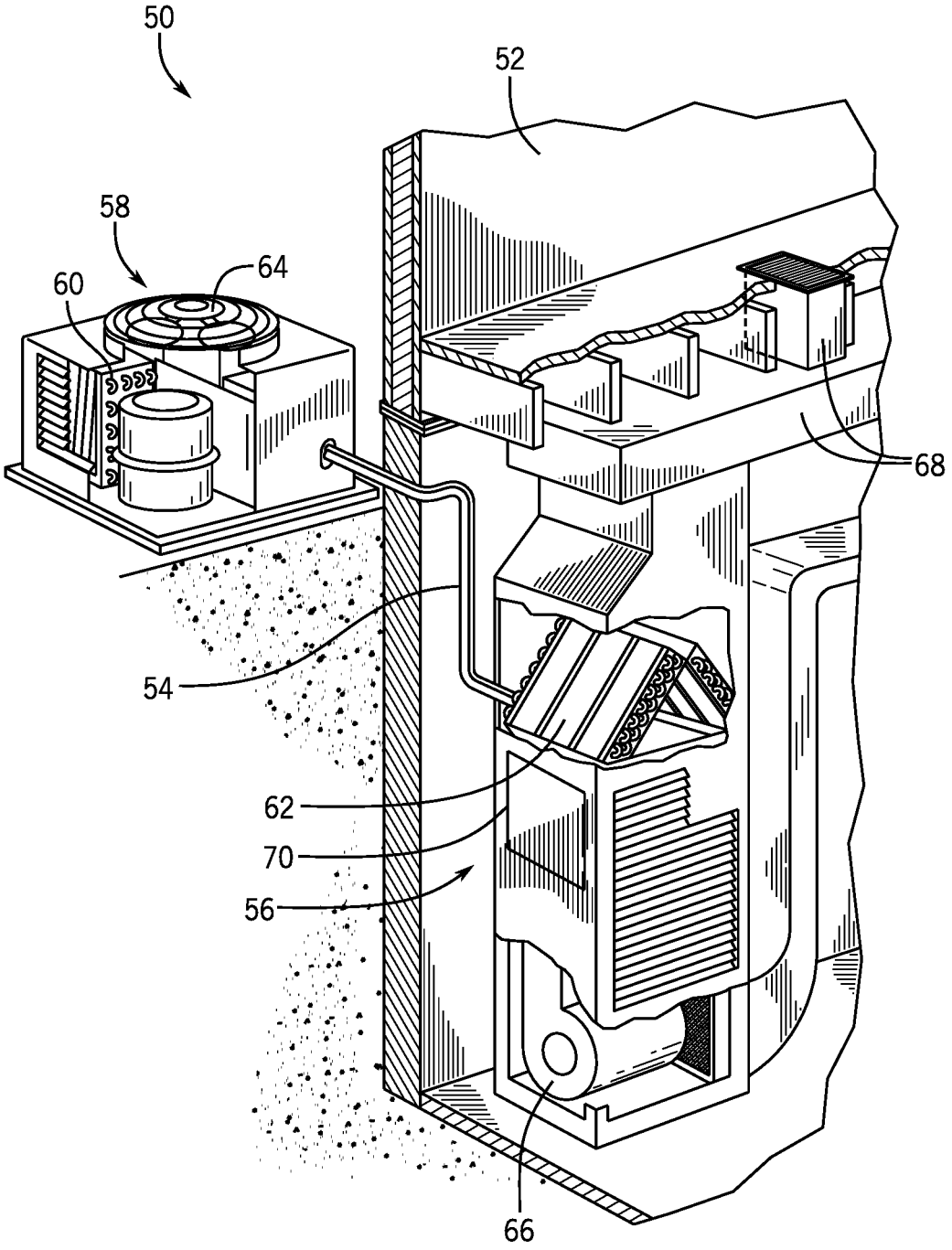
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower or fan 66 passes over the tubes or pipes and extracts heat from the combustion products. The heated air may then be routed from the furnace system 70 to the ductwork 68 for heating the residence 52.

Figure 4:
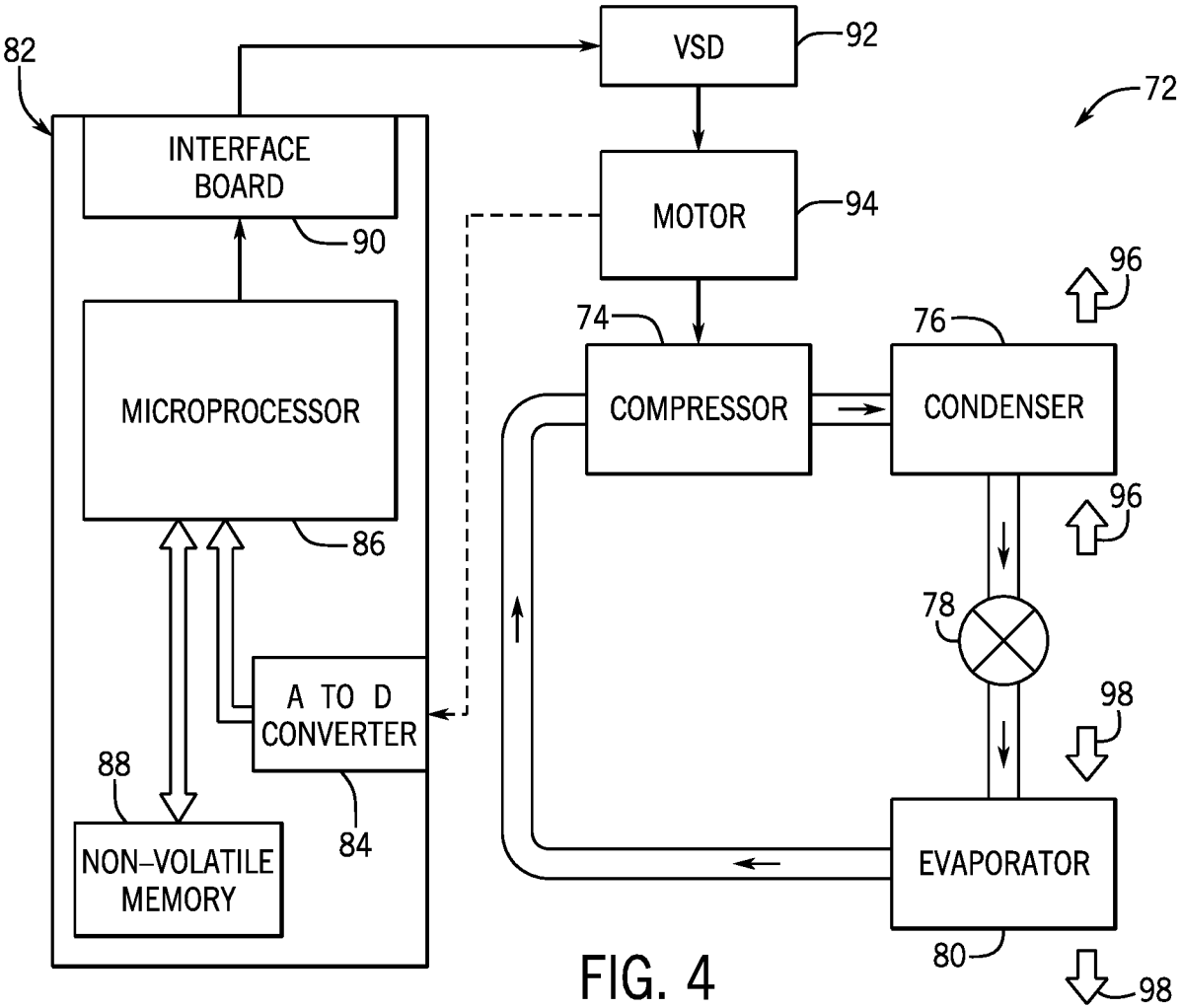
FIG. 4 is a schematic illustration of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As set forth above, embodiments of the present disclosure are directed to a collapsible air hood assembly that is configured to couple to an HVAC unit and transition from a collapsed configuration to a deployed configuration and vice versa. The air hood assembly may be configured to couple to the HVAC unit 12 of FIG. 1, the outdoor unit 58 illustrated in FIG. 3, and/or any other suitable HVAC unit. Additionally, the air hood assembly may transition from the deployed configuration to the collapsed configuration when transportation of the HVAC unit is desired. Therefore, the air hood assembly may remain coupled to the HVAC unit during transportation, thereby reducing or eliminating separate shipping costs for each of the air hood assembly and the HVAC unit. Additionally, adjusting the air hood assembly between the collapsed configuration and the deployed configuration may be less time-consuming when compared to a traditional installation of the air hood assembly. As such, an assembly time of the HVAC unit may also be reduced.

Figure 5:
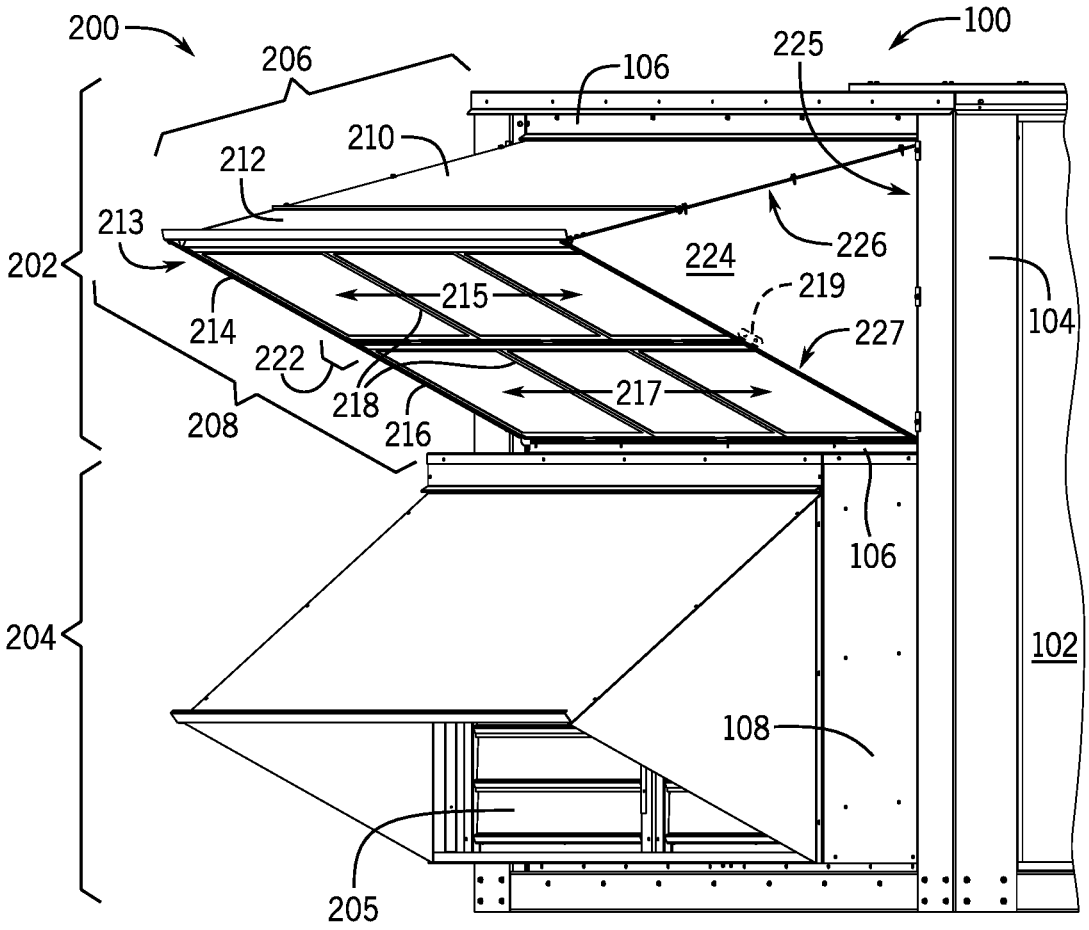
FIG. 5 is a perspective view of an embodiment of a portion of an HVAC unit having an air hood assembly in a deployed configuration, in accordance with an aspect of the present disclosure.

FIG. 5 is a perspective view of a side 102 (e.g., lateral side or surface) of an HVAC unit 100, illustrating an embodiment of an air hood assembly 200 (e.g., hood assembly, intake hood assembly) having an inlet hood 202 in a deployed configuration. As shown in the illustrated embodiment of FIG. 5, the HVAC unit 100 may include a housing 104 configured to support and secure the air hood assembly 200 on the side 102 of the HVAC unit 100. The housing 104 may also support and/or couple to other various components of the HVAC unit 100. For example, the housing 104 may include a first sub-frame 106 (e.g., frame, frame member, support structure) to which the inlet hood 202 may be secured, and a second sub-frame 108 (e.g., frame, frame member, support structure) to which an exhaust hood 204 of the HVAC unit 100 may be secured. The exhaust hood 204 may be configured to protect or cover a louver 205, which may be configured to regulate a flow of exhaust air discharged from the HVAC unit 100. It should be noted that a similar louver may be present within the inlet hood 202 and may be configured to regulate a flow of intake air received by the HVAC unit 100.

The air hood assembly 200 may include a top panel 206 (e.g., top panel assembly, top cover) and a filter assembly 208, each rotatably coupled to the first sub-frame 106. The top panel 206 includes a first panel portion 210 and a second panel portion 212 that may be adjustably coupled to one another. For example, during a transition of the air hood assembly 200 from a deployed configuration to a collapsed configuration, the second panel portion 212 may slide or translate relative to the first panel portion 210 to enable the first panel portion 210 to substantially cover and contain the filter assembly 208 within and/or against the side 102 of the housing 104 of the HVAC unit 100, as described in greater detail below. The filter assembly 208 may include a frame 213 (e.g., support structure) configured to support filters of the air hood assembly 200. For example, the frame 213 may include a first filter frame 214 (e.g., sub-frame) rotatably coupled to the top panel 206 and a second filter frame 216 (e.g., sub-frame) rotatably coupled to the first sub-frame 106 of the housing 104. The first filter frame 214 and the second filter frame 216 may each be configured to support one or more filters 215, 217. The filters 215, 217 may be configured to block particulates and/or contaminants from entering an interior of the HVAC unit 100 from the environment surrounding the HVAC unit 100, such as during operation of the HVAC unit 100. The filter assembly 208 may also include a mesh 218 to configured to secure and hold the one or more filters 215, 217 in the first filter frame 214 and the second filter frame 216.

The first filter frame 214 and the second filter frame 216 may also be rotatably coupled to one another by one or more hinge joints 219 (e.g., hinges, pivot connections, etc.). The one or more hinge joints 219 may be configured to couple the first and second filter frames 214, 216 together to facilitate the transition of the air hood assembly 200 from a deployed configuration to a collapsed configuration, as described in greater detail with reference to FIGS. 8 and 11A. As discussed in detail herein, the filter assembly 208 may be positioned over an opening (e.g., air inlet) of the HVAC unit 100. Accordingly, air may be drawn through the filters 215, 217 and into an interior of the HVAC unit 100 via a fan or blower of the HVAC unit 100. The air may be directed through the HVAC unit 100 and may pass over one or more heat exchangers within the HVAC unit 100 to condition the air.

In the deployed configuration, the first filter frame 214 and the second filter frame 216 may be extended and/or expanded out towards the environment and away from the HVAC unit 100 such that the first filter frame 214 and the second filter frame 216 are aligned with one another (e.g., side-by-side, adjacent one another) in an extended position. In the deployed configuration, a gap 222 may be formed between the first filter frame 214 and the second filter frame 216. The gap 222 may be occluded by a flexible material (e.g., a filter and/or cloth strip) configured to span the gap 222 and between the first filter frame 214 and the second filter frame 216. The gap 222 may be formed in the deployed configuration as a result of the spatial relationship of the first filter frame 214 relative to the second filter frame 216 (e.g., via the hinge joints 219), and the spatial relationship may facilitate transition of the air hood assembly 200 from the deployed configuration to the collapsed configuration and vice versa, as described in greater detail below. In the deployed configuration, the air hood assembly 200 may further incorporate a pair of side panels 224 (e.g., on opposite sides of the inlet hood 202) configured to couple to, secure, and/or support the top panel 206 and the filter assembly 208 in the extended position while in the air hood assembly 200 is in the deployed configuration. As shown in the illustrated embodiment of FIG. 5, the side panels 224 may extend laterally outward from the side 102 of the HVAC unit 100. For example, the side panels 224 may each include triangular geometry or profile having a first edge 225 configured to couple to and/or abut the housing 104 of the HVAC unit 100. Additionally, a second edge 226 of each side panel 224 may be configured to couple to the top panel 206. Further still, the side panels 224 may each include a third edge 227 configured to couple to and/or abut the filter assembly 208. The third edges 227 of the side panels 224 may also be configured to secure or lock the filter assembly 208 in the extended position while the air hood assembly 200 is in the deployed configuration. As discussed further below, the side panels 224 may be removed from the air hood assembly 200 to facilitate transition of the air hood assembly 200 from the deployed configuration to the collapsed configuration.

Figure 6:
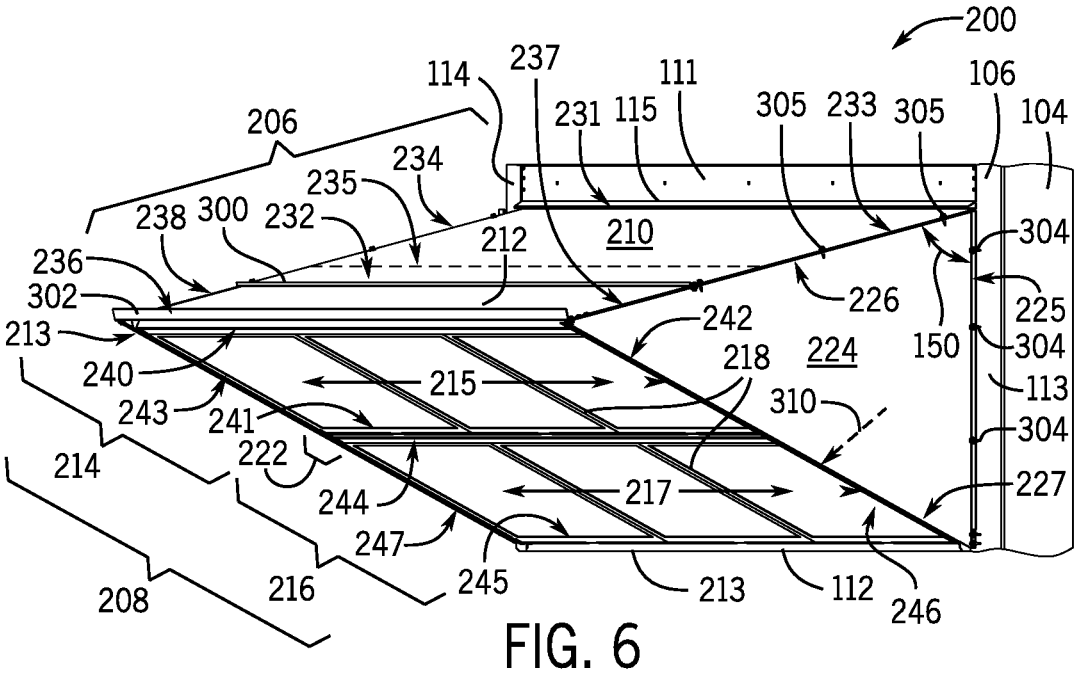
FIG. 6 is a perspective view of an embodiment of an air hood assembly in a deployed configuration, in accordance with an aspect of the present disclosure.

FIG. 6 is a perspective view of an embodiment of the air hood assembly 200 in the deployed configuration. The inlet hood 202 is configured to block water and/or other contaminants from entering the interior of the HVAC unit 100 and/or otherwise through the filters 215, 217. As discussed above, the top panel 206 may include the first panel portion 210 and the second panel portion 212 and may be disposed at an oblique angle 150 relative to the side 102 of the HVAC unit 100 such that the top panel 206 may provide protection for components of the air hood assembly 200 positioned below the top panel 206 (e.g., the filter assembly 208) and/or within the housing of the HVAC system 100 (e.g., a louver). The first panel portion 210 may have a top edge 231 (e.g., a base edge, first edge), a bottom edge 232 (e.g., a distal edge, second edge) opposite the top edge 231 and having a lip 300, and a pair of lateral edges 233, 234. The second panel portion 212 may also have a top edge 235 (e.g., overlapping edge, first edge), a bottom edge 236 (e.g., a distal edge, second edge) opposite the top edge 235 and having a lip 302, and a pair of lateral edges 237, 238. As illustrated, the top edge 235 of the second panel portion 212 may be positioned underneath or behind the first panel portion 210 to enable the second panel portion 212 to slide relative to the first panel portion 210. In the collapsed configuration of the air hood assembly 200, the second panel portion 212 may be retracted behind and substantially covered (e.g., via overlap) by the first panel portion 210. The first panel portion 210 may be configured to maintain its shape or geometry while transitioning from a deployed configuration to a collapsed configuration. For example, regardless of configuration (e.g., deployed, transitioning, collapsed) of the air hood assembly 200, the first panel portion 210 may remain fixed relative to the second panel portion 212, and the second panel portion 212 may slide or translate towards or away from the first panel portion 210. That is, the lip 302 of the second panel portion 212 may move towards the lip 300 of the first panel portion 210 when the air hood assembly 200 transitions from the deployed configuration to the collapsed configuration. For example, the second panel portion 212 may translate relative to the first panel portion 210 until the bottom edge 236 and the lip 302 of the second panel portion 212 contact and/or are adjacent to the bottom edge 232 and the lip 300 of the first panel portion 210. In the collapsed configuration, the first panel portion 212 may substantially cover and/or overlap with the second panel portion 210, as illustrated in FIG. 12. When the air hood assembly 200 transitions from the collapsed configuration to the deployed configuration, the bottom edge 236 and the lip 302 of the second panel portion 212 may extend away from the bottom edge 232 and the lip 300 of the first panel portion 210. In this manner, the top panel 206 enables the filter assembly 208 to extend out into the deployed configuration (e.g., with filter frames 214, 216 side-by-side). It should be noted that, as used herein, the term "top" is not limited to orientations or spatial relationships whereby an element (e.g., the top panel 206) is located above (e.g., vertically above) other elements (e.g., relative to gravity). That is, in some configurations (e.g., the collapsed configuration), the top panel 206 may be the most outward element relative to the housing 104 such that the top panel 206 substantially covers and contains other components of the air hood assembly 200 within the housing 104, as described in greater detail below.

As illustrated, the first edges 225 of the side panels 224 may be coupled to the housing 104 via one or more fasteners 304. The fasteners 304 may be pins or screws that are readily removed to facilitate the transition of the air hood assembly 200 from the deployed configuration to the collapsed configuration. The second edge 226 of the side panel 224 may be coupled to the top panel 206 via one or more fasteners 305. The fasteners 305 may be similar to fasteners 304 to enable ready removal of the side panels 224 to enable transition of the air hood assembly 200 to the collapsed configuration. The third edge 227 of the side panel 224 may be positioned above the filter assembly 208 (e.g., relative to gravity) in the deployed configuration in order to bias (e.g., via a force 310 in an outward and/or downward direction) and/or retain (e.g., secure) the filter assembly 208 in the extended positioned.

As described above, the filter assembly 208 may include the first filter frame 214, the second filter frame 216, filters 215, 217, and the mesh 218. The first filter frame 214 may have a top side 240 (e.g., distal side, first side), a bottom side 241 (adjoining side, second side), and a pair of lateral sides 242, 243. The second filter frame 216 may also have a top side 244 (e.g., adjoining side, first side), a bottom side 245 (e.g., mounting side, second side), and a pair of lateral sides 246, 247. When the filter assembly 208 is in the extended position, the bottom side 241 of the first filter frame 214 and the top side 244 of the second filter frame 216 may be separated by the gap 222. The bottom side 241 of the first filter frame 214 and the top side 244 of the second filter frame 216 are also rotatably coupled to one another such that the first filter frame 214 and the second filter frame 216 may angularly rotate towards and/or away from one another during transition of the air hood assembly 200 between the deployed configuration and the collapsed configuration via the hinge joints 219. The spatial relationship of the first filter frame 214 and the second filter frame 216 that results in the gap 222 in the deployed configuration may also provide additional space for the first filter frame 214 and the second filter frame 216 to rotate relative to one another. The gap 222 may be enclosed by a flexible material, such as a filter cloth strip, configured to fit within (e.g., fill, span) the gap 222, thereby blocking air flow between the first filter frame 214 and the second filter frame 216 and into the inlet hood 202.

The top side 240 of the first filter frame 214 may be rotatably coupled to the bottom edge 236 of the second panel portion 212. Further, each of the sides 240, 241, 242, 243, 244, 245, 246, and 247 of the first filter frame 214 and the second filter frame 216 may include or be formed from C-channels configured to facilitate installation of the filters 215, 217 therein. It should be noted that each of the filters 215, 217 may each include multiple individual filters. When the filter 215 is installed within the first filter frame 214, a gap (e.g., space, void) may extend between an edge of the filter 215 and the top side 240 of the first filter frame 214. This gap (e.g., within the C-channel forming the top side 240) may provide room for the filter 215 to be adjusted or manipulated during replacement of one or more of the filters 215 (e.g., without disassembling the filter assembly 208), as described in greater detail with reference to FIG. 13. It should be noted that each of the filter frame sides 240, 241, 242, 243, 244, 245, 246, and 247, which may be formed or defined by one or more C-channels, may provide a gap similar to that described above between the side of the corresponding filter frame 214, 216 and a respective side of the corresponding filter 215, 217 to facilitate installation and/or removal of the filters 215, 217.

As discussed above, various components of the air hood assembly 200 may be coupled to the first sub-frame 106. The first sub-frame 106 may have a top portion 111 (e.g., first portion), a bottom portion 112 (e.g., second portion) opposite the top portion 111 relative to an air inlet protected by the air hood assembly 200, a first side portion 113, and a second side portion 114 opposite the first side portion 113 relative to the air inlet protected by the air hood assembly 200. The top portion 111 may also include a top panel retainer 115 (e.g., clasp, clamp, bracket), which is described further below. Each portion 111, 112, 113, and 114 of the first sub-frame 106 may be configured to couple to and secure components of the air hood assembly 200 to the housing 104 of the HVAC unit 100. For example, the bottom side 245 of the second filter frame 216 may be rotatably coupled to the bottom portion 112 of the first sub-frame 106 via hinge joints 220, and the top edge 231 of the first panel portion 210 may be rotatably coupled to the first portion 111 of the first sub-frame 106 via the top panel retainer 115. Further, while in the deployed configuration, the first edges 225 of the side panels 224 may be coupled to the first side portion 113 and the second side portion 114, respectively, via the fasteners 304.

Figure 7B:
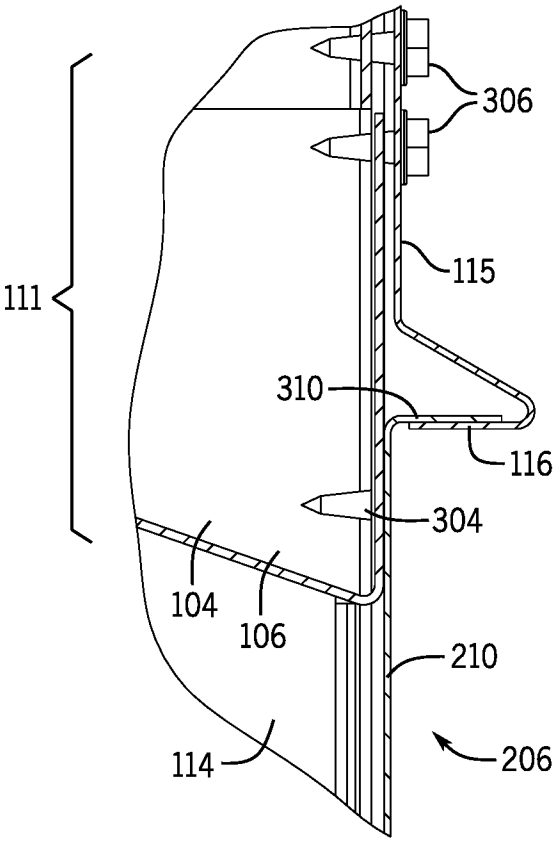
FIG. 7B is a cross-sectional side view of an embodiment of a top panel retainer of an air hood assembly in a collapsed configuration, in accordance with an aspect of the present disclosure.
Figure 7A:
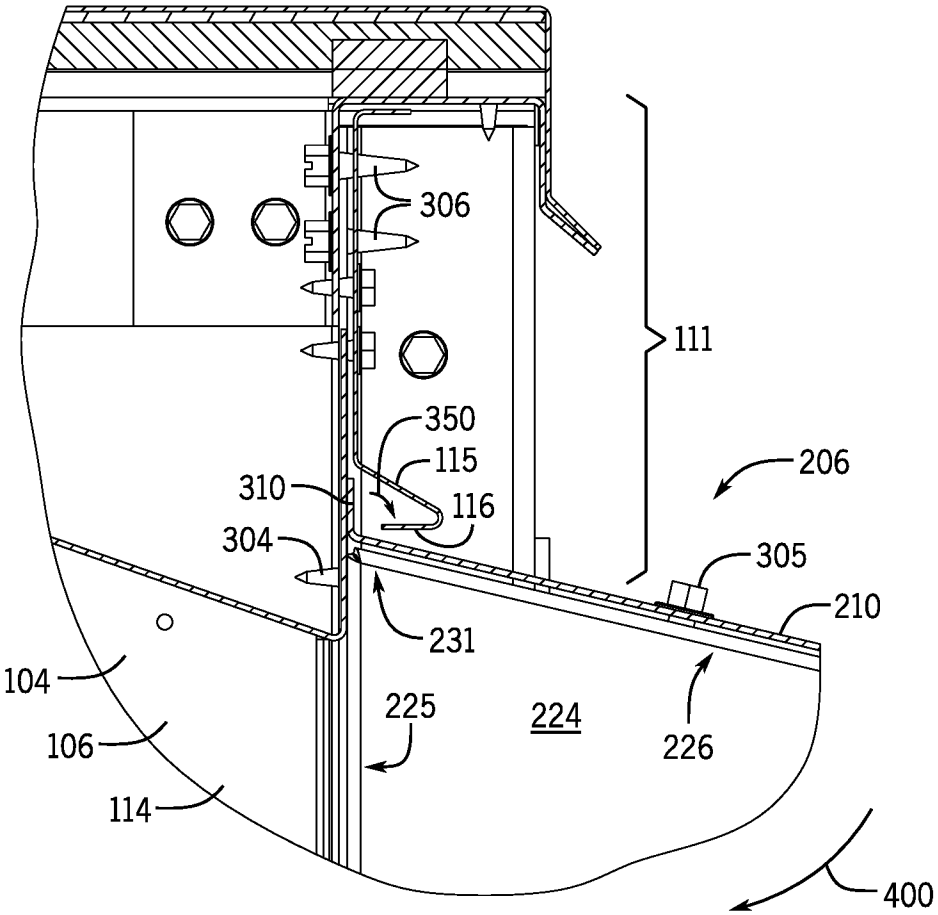
FIG. 7A is a cross-sectional side view of an embodiment of a top panel retainer of an air hood assembly in a deployed configuration, in accordance with an aspect of the present disclosure.

FIG. 7A is a side perspective view of an embodiment of the top panel retainer 115, which may be configured to facilitate the securement of the top edge 231 of the first panel portion 210 to the housing 104 of the HVAC system 100 in the deployed configuration. For example, the top panel retainer 115 may be secured to the top portion 111 of the first sub frame 106 via one or more fasteners 306. The one or more fasteners 306 may extend through the top portion 111 of the first sub frame 106 and into the top panel retainer 115, thereby securing the top panel retainer 115 to the housing 104. The top edge 231 of the first panel portion 210 may have a lip 310 that extends in a generally vertical direction when the air hood assembly 200 is in the deployed configuration, and the top panel retainer 115 may also have a lip 116 that extends in a generally horizontal direction.

As illustrated and discussed above, fasteners 304 may extend through the first edge 225 of the side panel 224 and into the second side portion 114 of the first sub-frame 106 to couple and secure the side panel 224 to the housing 104. Further, fasteners 305 may extend through the first panel portion 210 and into the second edge 226 of the side panel 224, thereby coupling and securing the first panel portion 210 to the side panel 224. When the fasteners 304, 305 are removed along with the side panels 224 (e.g., to transition the air hood assembly 200 from the deployed configuration to the collapsed configuration), the top panel 206 may rotate or pivot towards the housing 104 in a generally downward and/or inward direction 400 relative to the housing 104, and the lip 310 may rotate or pivot towards the lip 116 of the top panel retainer 115 in a generally downward and/or inward direction 350 relative to the lip 116. In the collapsed configuration, the top panel 206 extends along and generally flush with the housing 104, as discussed above. Additionally, in this position of the top panel 206, the lip 116 may extend along and rest against (e.g., above and/or on top of, relative to gravity) the lip 116, thereby securing the top panel 206 within the top panel retainer 115 in the collapsed configuration, as discussed in greater detail below with reference to FIG. 7B.

FIG. 7B is an exploded view of an embodiment of the top panel retainer 115 with the top panel 206 of the air hood assembly 200 in the collapsed configuration. When in the collapsed configuration, the lip 310 of the first panel portion 210 may be positioned above the lip 116 of the top panel retainer 115 relative to gravity. As illustrated, the lip 310 of the first panel portion 210 may rest against the lip 116 of the top panel retainer 115 in the collapsed configuration, such that the lip 116 of the top panel retainer 115 supports the top panel 206 via engagement with the lip 310 of the first panel portion 210. In this way, the top panel retainer 115 restricts or blocks the top panel 206 from moving downward relative to the top panel retainer 115. For example, the lip 116 of the top panel retainer 115 may be configured to support a weight of the top panel 206 while in the collapsed configuration. Further, the lip 116 may be configured to restrict the top panel 206 from rotating further inward, relative to the housing 104, upon reaching the collapsed configuration. Furthermore, as shown, the lip 310 and the lip 116 are dimensioned such that the lips 310, 116 substantially overlap with and contact one another in the collapsed configuration of the air hood assembly 200. For example, a full length or a substantially full length of the lip 310 rests on the lip 116, and the lip 116 extends toward the housing 104 beneath (e.g., relative to gravity) the full length or substantially full length of the lip 310. Thus, the top panel retainer 115 may block or mitigate inadvertent dislodging of the top panel 206 from the top panel retainer 115.

Turning now to FIG. 8A, a schematic view illustrating transition of an embodiment of the air hood assembly 200 between a deployed configuration and a collapsed configuration, is shown. During transition, the side panels 224 may be removed to enable rotation and/or pivoting of the top panel 206 relative to the housing 104, as enabled by the lip 116 of the top panel retainer 115 and the lip 310 of the first panel portion 210. As discussed above, the top panel 206 may include the first panel portion 210 and the second panel portion 212. During transition from the deployed configuration to the collapsed configuration, the top panel 206 may rotate in the downward and/or inward direction 400 relative to the housing 104 such that the filter assembly 208 may collapse and be protected and contained within the housing 104. Further, during transition, the second panel portion 212 may move in a generally inward direction 402 relative to the first panel portion 210. Because the second panel portion 212 is coupled to the first filter frame 214, when the second panel portion 212 slides inward relative to the first panel portion 210, the first filter frame 214 also moves inward towards the housing 104 of the HVAC unit 100 such that when the air hood assembly 200 is fully collapsed, the filter assembly 208 is covered and contained within the housing 104 by the top panel 206. During transition from the collapsed configuration to the deployed configuration, the top panel 206 may rotate in an outward and/or upward direction 500 relative to the housing 104. Further, the second panel portion 212 may move in a generally outward direction 502 relative to the first panel portion 210. In turn, the first filter frame 214 may move away from the housing 104 to provide additional space for the filter assembly 208 to move (e.g., rotate and/or pivot) into the extended position. To facilitate transition, the first filter frame 214 and the second filter frame 216 may be coupled together via the one or more hinge joints 219. The one or more hinge joints 219 may be configured to enable rotational movement between the first filter frame 214 and the second filter frame 216. Further, one or more additional hinge joints 220 may couple the second filter frame 216 to the first sub-frame 106. The one or more additional hinge joints 220 may enable rotational movement between the bottom side 245 of the second filter frame 216 and the bottom portion 112 of the first sub-frame 106. Such features are described in greater detail with reference to FIG. 11A and FIG. 11B.

As discussed above, the first filter frame 214 and the second filter frame 216 are rotatably coupled to one another by the one or more hinge joints 219. During transition from the deployed configuration to the collapsed configuration, the first filter frame 214 and the second filter frame 216 may rotate towards each other (e.g., about the one or more hinge joints 219) until the air hood assembly 200 is in the collapsed configuration. When the air hood assembly 200 is fully collapsed, the first filter frame 214 and the second filter frame 216 overlap with one another (e.g., in a side-by-side or adjacent arrangement) and may be substantially contained against the housing 104 (e.g., covered) by the top panel 206. For example, the bottom side 241 of the first filter frame 214 and the top side 244 of the second filter frame 216 may be rotatably coupled to one another via the hinge joints 219 such that the bottom side 241 of the first filter frame 214 and the top side 244 of the second filter frame 216 may move in a generally inward and/or upward direction 404 relative to the housing 104 when the air hood assembly 200 transitions from the deployed configuration to the collapsed configuration. As the bottom side 241 of the first filter frame 214 and the top side 244 of the second filter frame 216 pivot or rotate and move in the inward and/or upward direction 404, an inward surface 270 of the first filter frame 214 may pivot an inward and/or upward direction 274 relative to the top panel 206. Further, an inward surface 280 of the second filter frame 216 may pivot in an inward and/or upward direction 284 relative to the first sub-frame 106 of the housing 104. Thus, during transition from the deployed configuration to the collapsed configuration, the first filter frame 214 and the second filter frame 216 may rotate or pivot towards one another until they are substantially flush against one another and arranged to overlap one another. For example, in the collapsed configuration and relative to the housing 104, the first panel portion 210 is external to the second panel portion 212, the second panel portion 212 is external to the first filter frame 214, and the first filter frame 214 is external to the second filter frame 216. Thus, the first panel portion 210 substantially covers and contains the second panel portion 210 and the first and second filter frames 214, 216 against the housing 104 in the collapsed configuration. It should be noted that, as the second panel portion 212 moves in the inward direction 402 relative to the first panel portion 210, the top side 240 of the first filter frame 214 may move in a similar direction due to the coupling between the second panel portion 212 and the first filter frame 214.

During transition from the collapsed configuration to the deployed configuration, the bottom side 241 of the first filter frame 214 and the top side 244 of the second filter frame 216 may move in a generally outward and/or downward direction 504 relative to the housing 104 to enable transition of the filter assembly 208 into the extended position associated with the deployed configuration of the the air hood assembly 200. As the bottom side 241 of the first filter frame 214 and the top side 244 of the second filter frame 216 move in the outward and/or downward direction 504 relative to the housing 104, an outward surface 272 of the first filter frame 214 may rotate in an outward and/or downward direction 276 relative to the top panel 206 and an outward surface 282 of the second filter frame 216 may rotate in an outward and/or downward direction 286 relative to the first sub frame 106 of the housing 104. Thus, during transition from the collapsed configuration to the deployed configuration, the first filter frame 214 and the second filter frame 216 may rotate away from one another such that, when extended, the first filter frame 214 and the second filter frame 216 are aligned with one another (e.g., end-to-end) in the extended position. It should be noted that, as the second panel portion 212 moves outward relative to the first panel portion 210, the top side 240 of the first filter frame 214 may move in a similar direction due to the coupling between the second panel portion 212 and the first filter frame 214.

FIG. 8B a perspective view of an embodiment of the air hood assembly 200 transitioning from a deployed configuration to a collapsed configuration. As described above, the filter assembly 208 may be configured to fold or collapse towards the housing 104 when transitioning from the deployed configuration to the collapsed configuration. In the illustrated embodiment, as the filter assembly 208 collapses towards the first sub-frame 106 of the housing 104, the first filter frame 214 may be configured to sit generally flush against the top panel 206 such that the top panel 206 may cover (e.g., be disposed external to, relative to the housing 104) a portion of the first filter frame 214 and the filter assembly 208. Further, because the bottom edge 236 of the second panel portion 212 is rotatably coupled to the top side 240 of the first filter frame 214, as the second panel portion 212 slides or translates relative to the first panel portion 210, the first filter frame 214 may also slide or translate relative to the first panel portion 210 towards the housing 104. Thus, when in the collapsed configuration, the first panel portion 210 substantially covers and contains the filter assembly 208 within and/or against the housing 104.

FIG. 9 is a top-perspective view of an embodiment of the air hood assembly 200 in a deployed configuration. In the deployed configuration, the side panels 224 may be coupled to the first sub-frame 106 via fasteners 304 and to the first panel portion 210 via fasteners 305. Once the fasteners 304, 305 and side panels 224 are removed, the top panel 206 may rotate towards the first sub-frame 106 to the collapsed configuration. As discussed above, the top edge 235 of the second panel portion 212 may be positioned underneath the bottom edge 232 of the first panel portion 210, and the second panel portion 212 may be configured to slide or translate relative to the first panel portion 210 to enable the air hood assembly 200 to transition to the collapsed configuration. To facilitate this movement, the second panel portion 212 may have a slot 320 formed in each of the lateral edges 237, 238 of the second panel portion 212. The slot 320 may be configured to guide or direct the second panel portion 212 towards the first panel portion 210 via one or more bolts, as described in greater detail below.

For example, FIG. 10A shows an exploded view of an embodiment of the slot 320 configured to facilitate movement of the second panel portion 212 relative to the first panel portion 210. The slot 320 may span across a length 322 of the lateral edge 237 of the second panel portion 212. As discussed above, the top edge 235 of the second panel portion 212 may be positioned underneath the bottom edge 232 of the first panel portion 210, thereby enabling the second panel portion 212 to translate in either the inward direction 402 or outward direction 502 relative to the first panel portion 210, such as along a first axis 500. To facilitate the sliding of the second panel portion 212 relative to the first panel portion 210, a first bolt 330 (e.g., pin, fastener, etc.) may extend through the first panel portion 210 at the bottom edge 232 of the first panel portion 210 and into the slot 320. The first bolt 330 may be configured to couple the first panel portion 210 to the second panel portion 212 while also enabling movement between the first panel portion 210 and the second panel portion 212. That is, the first bolt 330 may be tight enough to secure the first panel portion 210 to the second panel portion 212, but loose enough to enable movement between the two portions 210, 212. A second bolt 332 (e.g., pin, fastener, etc.) may be positioned within the slot 320 along or at the bottom edge 236 of the second panel portion 212. One or more fasteners 308 may be configured to secure the second panel portion 212 to the side panel 224 while the air hood assembly 200 is in the deployed configuration. When transitioning from the deployed configuration to the collapsed configuration, the fasteners 305, 308 and the side panels 224 may be removed, and the first bolt 330 and the second bolt 332 may move along the slot 320 towards the first bolt 330 within the slot 320 to guide the second panel portion 212 in the upward direction 402 along the first axis 500. For example, because the first panel portion 210 remains fixed relative to the second panel portion 212, the first bolt 330 may also remain in a fixed position along the bottom edge 232 of the first panel portion 210. As the second panel portion 212 slides towards the first panel portion 210 along the first axis 500, the first bolt 330 may be contained within the slot 320 thereby limiting movement along a second axis 510. It should be noted that a similar (e.g., additional) slot 320 may be formed along the lateral edge 238 of the second panel portion 212 and may be configured to function similar to the slot 320 described above.

FIG. 10B is an exploded view of an embodiment of the coupling between the first panel portion 210 and the second panel portion 212 via the first bolt 330. As discussed above, the fastener 305 may be configured to couple the first panel portion 210 to the side panel 224 and may be readily removed to enable the second panel portion 210 to slide relative to the first panel portion 210 when the air hood assembly 200 transitions to the collapsed configuration. As illustrated, the bottom edge 232 of the first panel portion 210 is positioned above and/or external to the top edge 235 of the second panel portion 212, and the first bolt 330 may be configured to extend through the bottom edge 232 of the first panel portion 210 and into the second panel portion 212 via the slot 320. The first bolt 330 may be retained within the slot 320 by a nut 331 that is configured to secure the coupling between the first panel portion 210 and the second panel portion 212, as described above. That is, the nut 331 may be tight enough to couple the first panel portion 210 to the second panel portion 212 to one another, but loose enough to enable movement of the second panel portion 212 relative to the first panel portion 210 along the axis 500. For example, the first bolt 330 may extend through and be contained within the slot 320 such that as the second panel portion 212 may slide relative to the first panel portion 210, and movement (e.g., lateral movement) that is not along the axis 500 may be limited by the first bolt 330 retained within the slot 320. It should be noted that the lateral edge 238 of the second panel portion 212 may have a similar slot and fastener configuration as that discussed above.

As discussed above, one or more fasteners may be used to rotatably couple various components of the air hood assembly 200 to one another. FIG. 11A is a perspective view of an embodiment of the hinge joint 219 configured to rotatably couple the first filter frame 214 and the second filter frame 216. As discussed above, the gap 222 may be formed between the first filter frame 214 and the second filter frame 216 to provide additional space for the filter frames 214, 216 to rotate relative to one another. The hinge joint 219 may include a joining plate 600 (e.g., a hinge plate) including a first hole 601 and a second hole 602. The first filter frame 214 may be rotatably coupled to the joining plate 600 via a first rivet 603 (e.g., pin) extending through the first hole 601 and through the lateral side 242 of the first filter frame 214. The second filter frame 216 may be rotatably coupled to the joining plate 600 via a second rivet 604 (e.g., pin) extending through the second hole 602 and through the lateral side 246 of the second filter frame 216. By coupling the first filter frame 214 and the second filter frame 216 to the joining plate 600, the filter frames 214, 216 may rotate relative to each other when the air hood assembly 200 transitions between the deployed configuration and the collapsed configuration. It should be noted that the lateral side 243 of the first filter frame 214 and the lateral side 247 of the second filter frame 216 (illustrated in FIG. 6) may be coupled to one another by a similar hinge joint 219. Further, in some embodiments, the rivets 603, 604 may be self-tapping fastening screws, pins, or other suitable element about which the first filter frame 214 and/or second filter frame 216 may rotate.

FIG. 11B is a perspective view of an embodiment of the hinge joint 220 configured to rotatably couple the second filter frame 216 to the first sub-frame 106. The hinge joint 220 may be an L-shaped bracket (e.g., mounting flange) having a first attaching member 610 (e.g., first flange) and a second attaching member 612 (e.g., second flange). The first attaching member 610 may be configured to secure the hinge joint 220 to the first sub-frame 106 of the housing 104 via one or more bolts 620 or other mechanical fasteners. The one or more bolts 620 may secure the first attaching member 610 to the first sub-frame 106 such that the hinge joint 220 is fixedly attached to the first sub-frame 106. The second attaching member 612 may have a hole 614 configured to facilitate the adjustable coupling between the second filter frame 216 and the first sub-frame 106. That is, the second filter frame 214 may be rotatably coupled to the second attaching member 612 via a rivet 615 extending through the hole 614 and through the lateral side 246 of the second filter frame 216. By coupling the second filter frame 216 to the second attaching member 612, the second filter frame 214 is configured to rotate relative to the first sub-frame 106 of the housing 104, thereby facilitating transition of the air hood assembly 200 between the deployed configuration and the collapsed configuration. It should be noted that a similar hinge joint 220 may be included on the lateral side 247 (illustrated in FIG. 6) of the second filter frame 216, and in some embodiments, the rivet 615 may include a self-tapping fastening screw, pin, or other suitable element about which the second filter frame 216 may rotate.

Referring now to FIG. 12, a perspective view of an embodiment of the air hood assembly 200 in a collapsed configuration is illustrated. As shown, the side panels 224 are removed such that the top panel 206 may rotate to rest along the housing 104 (e.g., in a generally vertical orientation) and to substantially cover and contain the filter assembly 208 against and/or within the housing 104 of the HVAC unit 100. As discussed above, during transition from the deployed configuration to the collapsed configuration, the second panel portion 212 may slide or translate relative to the first panel portion 210, such that the second panel portion 212 may be substantially covered by the first panel portion 210. Indeed, the first panel portion 210 may sit generally flush against the housing 104, thereby protecting and containing the filter assembly 208 within the housing 104. That is, the first panel portion 210 may overlap and be disposed external to the second panel portion 212 and the filter assembly 208 contained within the housing 104. For example, as illustrated, the bottom edge 232 of the first panel portion 210 is substantially aligned with the bottom edge 236 of the second panel portion 212, such that the second panel portion 212 is substantially covered and/or disposed behind by the first panel portion 210 (e.g., relative to an external facing surface of the first panel portion 210). That is, in the collapsed configuration, the first panel portion 210 may be an outermost layer of the air hood assembly 200 relative to the housing 104, and the second panel portion 212 may be positioned internal to the first panel portion 210 relative to the housing 104. Such a configuration enables the top panel 206 to cover and protect the filter assembly 208 within the housing 104 and further aids in installation of the air hood assembly 200. More specifically, the filters 215, 217 and the air hood assembly 200 may be installed with the HVAC unit 100 prior to transportation of the HVAC unit 100 (e.g., to an installation site), and the HVAC unit 100 may then be transported (e.g., shipped) without removing the filters 215, 217 and the air hood assembly 200 because the filter assembly 208 is substantially covered and protected by the top panel 206. Additionally, in the collapsed configuration, the air hood assembly 200 does not significantly and/or materially increase a footprint of the HVAC unit 100, thereby reducing delivery, transportation, and installation costs associated with the HVAC unit 100.

FIG. 13 is a schematic view of an embodiment of the filter assembly 208 with the first filter frame 214 and the second filter frame 216 arranged in the extended position (e.g., end-to-end, adjacent one another) and with the filters 215, 217 installed. As discussed above, the first filter frame 214 and the second filter frame 216 may be separated by the gap 222 and may be coupled together via the hinge joints 219. The filters 215, 217 may be retained within the first and second filter frames 214, 216 by the mesh 218. The gap 222 may be formed in the deployed configuration as a result of the spatial relationship of the first filter frame 214 relative to the second filter frame 216 (e.g., via the hinge joints 219), and the spatial relationship may facilitate transition of the air hood assembly 200 from the deployed configuration to the collapsed configuration and vice versa. Further, each of the sides 240, 241, 242, 243, 244, 234, 246, and 247 of the filter frames 214, 216 may include or be formed from C-channels configured to facilitate installation of the filters 215, 217 therein. For example, when the filters 215, 217 are installed, a first gap 700 may be formed between a top edge 800 of the filter 215 and the top side 240 of the first filter frame 214, and a second gap 702 may be formed between a bottom edge 801 of the filter 215 and the bottom side 241 of the first filter frame 214. Further, a third gap 704 may be formed between a first lateral edge 802 of the filter 215 and the lateral side 242 of the first filter frame 214, and a fourth gap 706 may be formed between a second lateral edge 803 of the filter 215 and the lateral side 243 of the first filter frame 214. Similarly, a first gap 710 may be formed between a top edge 804 of the filter 217 and the top side 244 of the second filter frame, and a second gap 712 may be formed between a bottom edge 805 of the filter 217 and the bottom side 245 of the second filter frame 216. Further, a third gap 714 may be formed between a first lateral edge 806 of the filter 217 and the lateral side 246 of the second filter frame 216, and a fourth gap 716 may be formed between a second lateral edge 807 of the filter 217 and the lateral side 247 of the second filter frame 216. Each of the gaps 700, 702, 704, 706, 710, 712, 714, 716 may be configured to enable the filters 215, 217 to move relative to the first and second filter frames 214, 216 and may provide adequate clearance for the filters 215, 217 to be readily removed or installed as need. For example, to remove the filter 215, the top edge 800 of the filter 215 may be transitioned into the gap 700 towards the top side 240 of the first filter frame 214 such that the bottom edge 801 of the filter 215 may no longer constrained or held by the bottom side 241 of the first filter frame 214, thereby enabling the removal of the filter 215 from the first filter frame 214. Similarly, to remove the filter 217, the top edge 804 of the filter 217 may be transitioned into the gap 710 towards the top side 244 of the second filter frame 216 such that the bottom edge 805 of the filter 217 may no longer constrained or held by the bottom side 245 of the second filter frame 216. It should be noted that any of the gaps 700, 702, 704, 706, 710, 712, 714, 716 may provide clearance for the filters 215, 217 to be removed from the filter frames 214, 216, and that the removal of filters is not limited to the method described above. That is, in some embodiments, the filters 215, 217 may be transitioned into the gaps 702, 712 towards the bottom sides 241, 245 of the first and second filter frames 214, 216 such that the top edges 800, 804 of the filters 215, 217 are no longer held or constrained by the top sides 240, 244 of the first and second filter frames 214, 216. In other embodiments, the filters 215, 217 may be moved into the gaps 704, 706, 714, 716 towards the lateral sides 242, 243, 246, 247 of the first and second filter frames 214, 216 in a similar fashion such that the filters 215, 217 are no longer constrained by one or more surfaces of the first and second filter frames 214, 216. As noted above, each filter 215, 217 may include one or more individual filters (e.g., a plurality of filters) that each may be individually removed via movement into one of the gaps as described above.

Providing a collapsible air hood assembly capable of transitioning between a deployed configuration and a collapsed configuration, in accordance with the present disclosure, can reduce the size (e.g., footprint) of the HVAC unit and protect components within the air hood assembly (e.g., filters) during transportation, thereby reducing time and transportation costs associated with the delivery of the HVAC units. Further, by configuring the air hood assembly as described above, the air hood assembly may provide protection to certain components of the HVAC system that would otherwise need to be removed and reinstalled upon delivery of the HVAC unit, and additional time and costs associated with assembly of the HVAC unit may be reduced.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A hood assembly for a heating, ventilation, and air conditioning (HVAC) unit, comprising:

a top panel comprising a first panel portion and a second panel portion adjustably coupled to one another, wherein the top panel is configured to rotatably couple to a housing of the HVAC unit; and a filter frame rotatably coupled to the top panel, wherein the filter frame is configured to support at least one filter, wherein the hood assembly is adjustable between a collapsed configuration and a deployed configuration, the first panel portion and the second panel portion are configured to translate relative to one another during transition of the hood assembly between the collapsed configuration and the deployed configuration, and the top panel is configured to contain the filter frame within the housing in the collapsed configuration.

2. The hood assembly of claim 1, wherein the top panel is substantially flush with the housing in the collapsed configuration.

3. The hood assembly of claim 1, wherein the filter frame comprises a first sub-frame configured to support a first filter and a second sub-frame configured to support a second filter, and wherein the first sub-frame and the second sub-frame are rotatably coupled to one another.

4. The hood assembly of claim 3, wherein the first sub-frame is rotatably coupled to the top panel, and the second sub-frame is configured to rotatably couple to the housing.

5. The hood assembly of claim 3, wherein the first sub-frame and the second sub-frame are each formed from a respective plurality of C-channels.

6. The hood assembly of claim 1, wherein the hood assembly is configured to transition between the collapsed configuration and the deployed configuration with the at least one filter installed with the filter frame.

7. The hood assembly of claim 1, wherein the second panel portion is configured to slide relative to the first panel portion during transition of the hood assembly between the collapsed configuration and the deployed configuration.

8. The hood assembly of claim 1, comprising a side panel configured to couple to the top panel in the deployed configuration to retain the hood assembly in the deployed configuration.

9. The hood assembly of claim 8, wherein the side panel is configured to be decoupled from the top panel in the collapsed configuration.

10. A heating, ventilation, and air conditioning (HVAC) unit, comprising:

a housing;

an intake hood assembly coupled to the housing and configured to transition between a collapsed configuration and a deployed configuration;

a top cover of the intake hood assembly rotatably coupled to the housing and comprising a first panel and a second panel, wherein the second panel is configured to translate relative to the first panel during transition of the intake hood assembly between the collapsed configuration and the deployed configuration; and a filter frame rotatably coupled to the top cover and configured to support at least one filter, wherein the top cover and the filter frame are configured to rotate relative to one another and relative to the housing during transition of the intake hood assembly between the collapsed configuration and the deployed configuration.

11. The HVAC unit of claim 10, wherein the filter frame comprises a first sub-frame configured to support a first plurality of filters and a second sub-frame configured to support a second plurality of filters, and wherein the first sub-frame and the second sub-frame are rotatably coupled to one another.

12. The HVAC unit of claim 11, wherein the first sub-frame and the second sub-frame overlap with one another and are disposed within an interior of the housing in the collapsed configuration.

13. The HVAC unit of claim 12, wherein the top cover overlaps with the first sub-frame and the second sub-frame and is external to the first sub-frame and the second sub-frame, relative to the interior of the housing, in the collapsed configuration.

14. The HVAC unit of claim 11, wherein the first sub-frame and the second sub-frame are positioned adjacent one another to receive an air flow in the deployed configuration.

15. The HVAC unit of claim 10, wherein the top cover extends from the housing at an oblique angle in the deployed configuration, and the top cover extends substantially flush with the housing in the collapsed configuration.

16. The HVAC unit of claim 10, comprising a first side panel and a second side panel of the intake hood assembly, wherein the first side panel and the second side panel are configured to couple to the top cover on opposite sides of the top cover to retain the intake hood assembly in the deployed configuration, and wherein the first side panel and the second side panel are configured to be decoupled from the top cover in the collapsed configuration.

17. An intake hood assembly for a heating, ventilation, and air conditioning (HVAC) unit, comprising:

a top panel comprising a first panel portion and a second panel portion adjustably coupled to one another, wherein the top panel is configured to couple to a housing of the HVAC unit; and a filter frame coupled to the top panel, wherein the filter frame comprises a first sub-frame configured to support a first filter and a second sub-frame configured to support a second filter, wherein the intake hood assembly is adjustable between a collapsed configuration and a deployed configuration, the first panel portion and the second panel portion are configured to translate relative to one another during transition of the intake hood assembly between the collapsed configuration and the deployed configuration, and the first sub-frame and the second sub-frame are configured to rotate relative to one another during transition of the intake hood assembly between the collapsed configuration and the deployed configuration.

18. The intake hood assembly of claim 17, wherein the top panel is configured to rotate relative to the housing during transition of the intake hood assembly between the collapsed configuration and the deployed configuration.

19. The intake hood assembly of claim 17, wherein the intake hood assembly transitions between the collapsed configuration and the deployed configuration with the first filter installed with the first sub-frame and with the second filter installed with the second sub-frame.

20. The intake hood assembly of claim 17, wherein the first sub-frame is configured to support a first plurality of filters including the first filter, and the second sub-frame is configured to support a second plurality of filters including the second filter.

* * * * *